US007866387B2

(12) United States Patent
van Zuilekom et al.

(10) Patent No.: US 7,866,387 B2
(45) Date of Patent: Jan. 11, 2011

(54) PACKER VARIABLE VOLUME EXCLUDER AND SAMPLING METHOD THEREFOR

(75) Inventors: Anthony H. van Zuilekom, Houston, TX (US); Mark A. Proett, Houston, TX (US); Michael T. Pelletier, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/356,229

(22) Filed: Jan. 20, 2009

(65) Prior Publication Data

US 2009/0183882 A1 Jul. 23, 2009

Related U.S. Application Data

(63) Continuation of application No. PCT/US2007/016558, filed on Jul. 23, 2007.

(60) Provisional application No. 60/820,061, filed on Jul. 21, 2006.

(51) Int. Cl.
*E21B 43/38* (2006.01)
*E21B 33/127* (2006.01)

(52) U.S. Cl. ..... 166/265; 166/191; 166/54.1

(58) Field of Classification Search ..... 166/250.03, 166/264, 265, 266, 54.1, 387, 191, 187
See application file for complete search history.

(56) References Cited

U.S. PATENT DOCUMENTS 2,564,198 A * 8/1951 Elkins ..... 73/152.18
3,050,118 A * 8/1962 Elkins ..... 166/297
3,121,459 A 2/1964 Van Ness, Jr.
3,323,361 A 6/1967 Lebourg
3,430,711 A 3/1969 Taggart
3,611,799 A 10/1971 Davis
3,924,463 A 12/1975 Urbanosky
3,934,468 A 1/1976 Brieger
4,241,787 A * 12/1980 Price ..... 166/105

(Continued)

FOREIGN PATENT DOCUMENTS

CA 2605441 12/2006

(Continued)

OTHER PUBLICATIONS

"International Application Serial No. PCT/US2007/016558, International Search Report mailed Dec. 5, 2007", 3 pgs.

(Continued)

*Primary Examiner*—Kenneth Thompson
(74) *Attorney, Agent, or Firm*—Schwegman, Lundberg & Woessner, P.A.

(57) ABSTRACT

A down hole apparatus includes a first expandable packer and a second expandable packer, where the first expandable packer longitudinally spaced from the second expandable packer. The apparatus further includes an optional expandable bladder disposed at a longitudinal location between the first expandable packer and the second expandable packer. The expandable bladder inflates to displace drilling fluid between the first and second bladder elements. The down hole apparatus can optionally displace drilling fluid between the first and second bladder elements with another fluid. Fluids and/or slurry can be selectively removed using ports between the first and second expandable packers, and optionally placed in sample chambers, or expelled to the bore hole.

23 Claims, 10 Drawing Sheets

U.S. PATENT DOCUMENTS

| | | | | |
|---|---|---|---|---|
| 4,246,782 | A | 1/1981 | Hallmark | |
| 4,287,946 | A | 9/1981 | Brieger | |
| 4,339,948 | A | 7/1982 | Hallmark | |
| 4,369,654 | A | 1/1983 | Hallmark | |
| 4,392,376 | A | 7/1983 | Lagus et al. | |
| 4,416,152 | A | 11/1983 | Wilson | |
| 4,513,612 | A | 4/1985 | Shalek | |
| 4,535,843 | A | 8/1985 | Jageler | |
| 4,573,532 | A | 3/1986 | Blake | |
| 4,635,717 | A | 1/1987 | Jageler | |
| 4,690,216 | A | 9/1987 | Pritchard, Jr. | |
| 4,860,581 | A | 8/1989 | Zimmerman et al. | |
| 4,879,900 | A | 11/1989 | Gilbert | |
| 4,936,139 | A | 6/1990 | Zimmerman et al. | |
| 4,994,671 | A | 2/1991 | Safinya et al. | |
| 5,230,244 | A | 7/1993 | Gilbert | |
| 5,335,542 | A | 8/1994 | Ramakrishnan et al. | |
| 5,337,838 | A | 8/1994 | Sorensen | |
| 5,540,280 | A | 7/1996 | Schultz et al. | |
| 5,622,223 | A | 4/1997 | Vasquez | |
| 5,765,637 | A | 6/1998 | Dietle et al. | |
| 5,770,798 | A | 6/1998 | Georgi et al. | |
| 5,799,733 | A | 9/1998 | Ringgenberg et al. | |
| 5,803,186 | A | 9/1998 | Berger et al. | |
| 5,826,662 | A | 10/1998 | Beck et al. | |
| 5,934,374 | A | 8/1999 | Hrametz et al. | |
| 6,006,834 | A | 12/1999 | Skinner | |
| 6,032,737 | A * | 3/2000 | Brady et al. | 166/265 |
| 6,164,126 | A | 12/2000 | Ciglenec et al. | |
| 6,176,323 | B1 | 1/2001 | Weirich et al. | |
| 6,178,815 | B1 | 1/2001 | Felling et al. | |
| 6,223,822 | B1 | 5/2001 | Jones | |
| 6,230,557 | B1 | 5/2001 | Ciglenec et al. | |
| 6,277,286 | B1 * | 8/2001 | Sontvedt et al. | 166/250.03 |
| 6,301,959 | B1 | 10/2001 | Hrametz et al. | |
| 6,343,507 | B1 | 2/2002 | Felling et al. | |
| 6,568,487 | B2 | 5/2003 | Meister et al. | |
| 6,622,554 | B2 | 9/2003 | Manke et al. | |
| 6,719,049 | B2 | 4/2004 | Sherwood et al. | |
| 6,722,432 | B2 | 4/2004 | Spiers et al. | |
| 6,877,559 | B2 | 4/2005 | Hashem | |
| 2002/0100585 | A1 | 8/2002 | Spiers et al. | |
| 2003/0234120 | A1 | 12/2003 | Paluch et al. | |
| 2004/0079527 | A1 | 4/2004 | Meister et al. | |
| 2004/0163808 | A1 | 8/2004 | Ringgenberg et al. | |

FOREIGN PATENT DOCUMENTS

| | | | |
|---|---|---|---|
| EP | 0522628 | A2 | 1/1993 |
| EP | 0911485 | A2 | 4/1999 |
| GE | 2390105 | A | 12/2003 |
| WO | WO-01/98630 | A1 | 12/2001 |
| WO | WO-02/20944 | A1 | 3/2002 |
| WO | WO-02/37072 | A2 | 5/2002 |
| WO | WO-2006/130178 | A2 | 12/2006 |
| WO | WO-2008/011189 | A1 | 1/2008 |

OTHER PUBLICATIONS

"International Application Serial No. PCT/US2007/016558, Written Opinion mailed Dec. 5, 2007", 6 pgs.

Hammond, P. S., "One- and Two-Phase Flow During Fluid Sampling by a Wireline Tool", *Transport in Porous Media*, 6, (1991), 229-330.

Hashem, M. N., et al., "Determination of Producible Hydrocarbon Type and Oil Quality in Wells Drilled with Synthetic Oil-Based Muds", *SPE Reservoir Evaluation # Engineering*, 2, (Apr. 1999), 125-133.

* cited by examiner

PACKER VARIABLE VOLUME EXCLUDER AND SAMPLING METHOD THEREFOR

RELATED APPLICATIONS

This application is a continuation under 35 U.S.C. 111(a) of International Application No. PCT/US2007/016558, filed Jul. 23, 2007 and published as WO 2008/011189 A1 on Jan. 24, 2008, which claimed priority under 35 U.S.C. 119 (e) to U.S. Provisional Patent Application Ser. No. 60/820,061, filed Jul. 21, 2006; which applications and publication are incorporated herein by reference and made a part hereof.

BACKGROUND

Formation testers, such as packer-based formation testers, have a large volume of fluid trapped between the packers. This trapped fluid is a mixture of one or more of drilling mud, filter cake (solid portion of the drilling mud), and drill formation bits suspended in the mud during drilling as cuttings or dislodged during the running of the tool. The fluid is also characterized as a slurry or suspension.

During testing, the trapped fluid contaminates the fluids entering the closed area between the packers, and it is time-consuming to pump the fluid. Furthermore, the fluid is prone to plugging screens in the pump and causing premature valve failure in the pumping system.

BRIEF DESCRIPTION OF THE DRAWINGS

Embodiments of the invention may be best understood by referring to the following description and accompanying drawings which illustrate such embodiments. The reference numbers are the same for those elements that are the same or similar across different Figures. In the drawings.

DETAILED DESCRIPTION OF THE DRAWINGS

Figure 1:
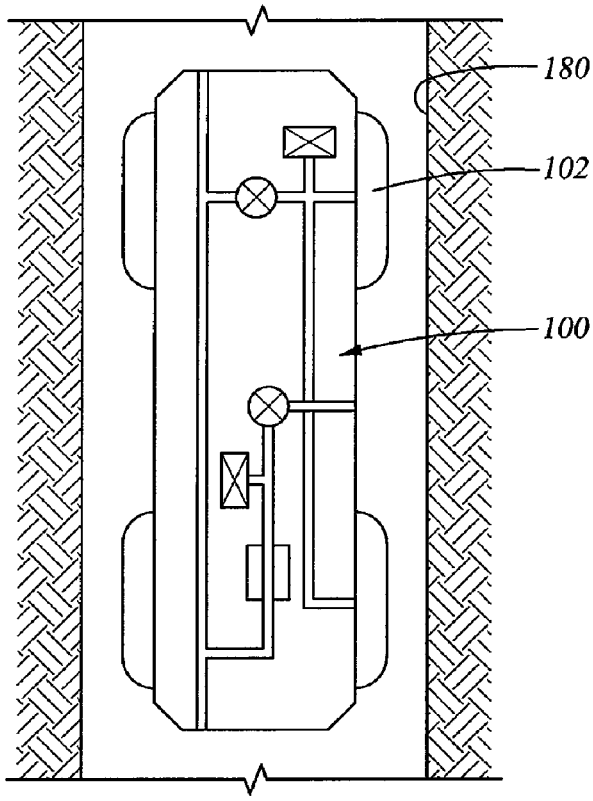
FIG. 1 illustrates a schematic view of a portion of a down hole apparatus as constructed in accordance with at least one embodiment.

In the following description of some embodiments of the present invention, reference is made to the accompanying drawings which form a part hereof, and in which are shown, by way of illustration, specific embodiments of the present invention which may be practiced. In the drawings, like numerals describe substantially similar components throughout the several views. These embodiments are described in sufficient detail to enable those skilled in the art to practice the present invention. Other embodiments may be utilized and structural, logical, and electrical changes may be made without departing from the scope of the present invention. The following detailed description is not to be taken in a limiting sense, and the scope of the present invention is defined only by the appended claims, along with the full scope of equivalents to which such claims are entitled.

A packer apparatus and method includes a downhole apparatus that includes a means for displacing fluid between two or more elements, such as two testing packers. In an option, the means for displacing fluid includes an inflatable bladder, where the bladder may be quite insubstantial, and/or will operate near hydrostatic pressure. In another option, the bladder may be inflated by chemically generated gas, fluids from the hydrostatic column, or fluid (liquid or HP gas) carried into the hole with the tool in separate chambers. The fluid used to inflate the bladder can be "clean" carried within large volume chambers on the tool. In yet another option, the inflatable bladder may be a third packer. The bladder maybe inflated and deflated with a pump, such as a pump that is suited to pump wellbore fluids or highly contaminated fluids.

Optionally, the packer apparatus would have an additional flow path in communication with the hydrostatic column and with a valve to prevent back flow after fluid has been removed from the trapped volume. In an option, the flow path would be the lowest point in the volume trapped by the two testing packers. Plugging of test screens and the fluid flow paths is reduced, resulting in improved performance of the packer tool. Furthermore, if the bladder is inflated with mud column fluids, the fluid is only filtered at the screens only once.

Figure 5:
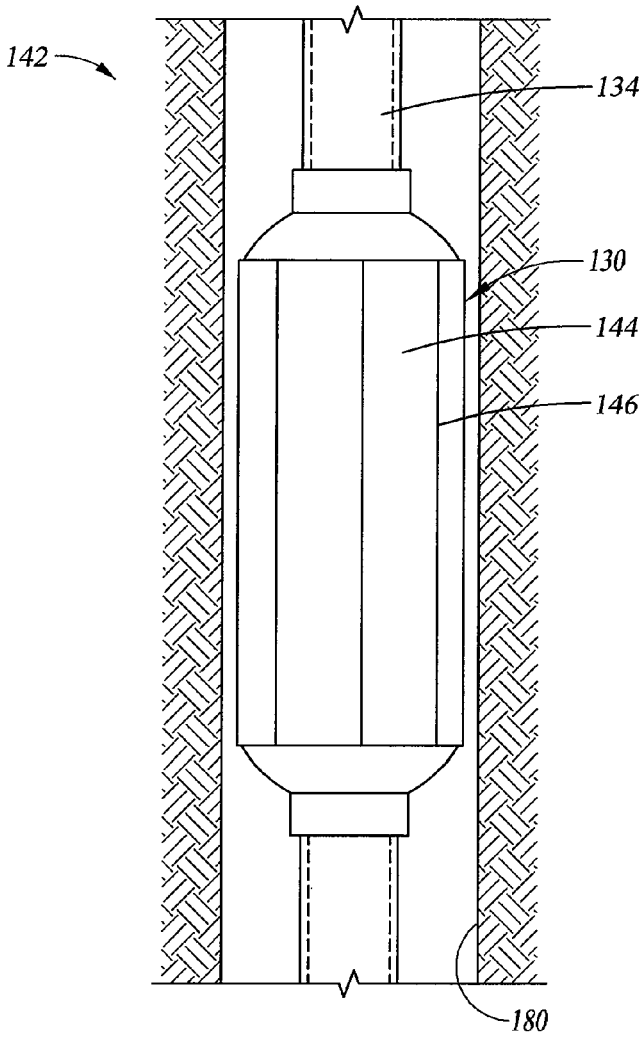
FIG. 5 illustrates a portion of a down hole apparatus as constructed in accordance with at least one embodiment.

If the bladder is a packer section, it can be potentially used as a backup for "main packers." The bladder can be designed to squeegee the surface of the well bore, driving the surface mud cake out of the test volume (FIG. 5).

In an option, an elastic member may be built into bladder to return the bladder to a preferred shape during deflation. The bladder maybe designed to "pop" the remnants prevented from plugging intake screens used for testing, such as retracted or chemically attacked. In some cases no bladder at all may be appropriate.

In another option, a method includes introducing a gas to displace the trapped volume. The method further optionally includes pumping the gas from the system or chemically combining the gas to form a liquid.

In another option, the downhole apparatus includes one or more ports disposed longitudinally between the first and second expandable packers. The ports are operatively coupled with one or more pumps. For instance, an upper port and a lower port can be operatively coupled with a single pump. Alternatively, a first pump is operatively coupled with the upper port, and a second pump is operatively coupled with the lower port. The ports are used to selectively pump fluid that separates in the space between the first and second expandable packers.

The method and apparatus allow for removal of the fluid trapped between the packers before or during initiating flow from the formation interval. It further allows for reduction in the amount of wear and tear on the pumping system. The method and apparatus optionally include employing the use of a squeegee to clean the borehole, for instance, to wipe a surface of the test interval driving the slime and solids away from inlet ports required for testing the formation. The above and below methods or apparatus, or embodiments and combinations thereof, can be used in open hole testing, formation testers, products such as the Reservoir Description Tool (RDT), and/or some applications of a system for a method of analysis surge testing.

Figure 2:
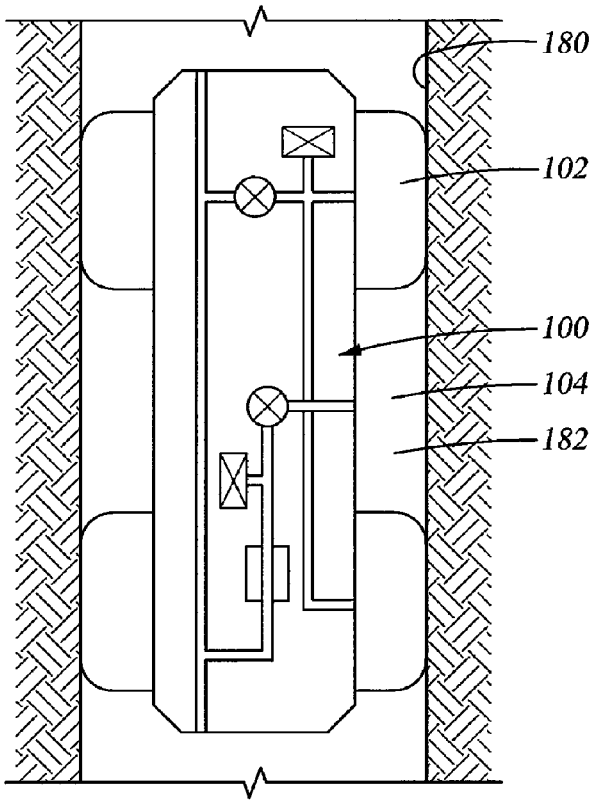
FIG. 2 illustrates a schematic view of a portion of a down hole apparatus as constructed in accordance with at least one embodiment.
Figure 3:
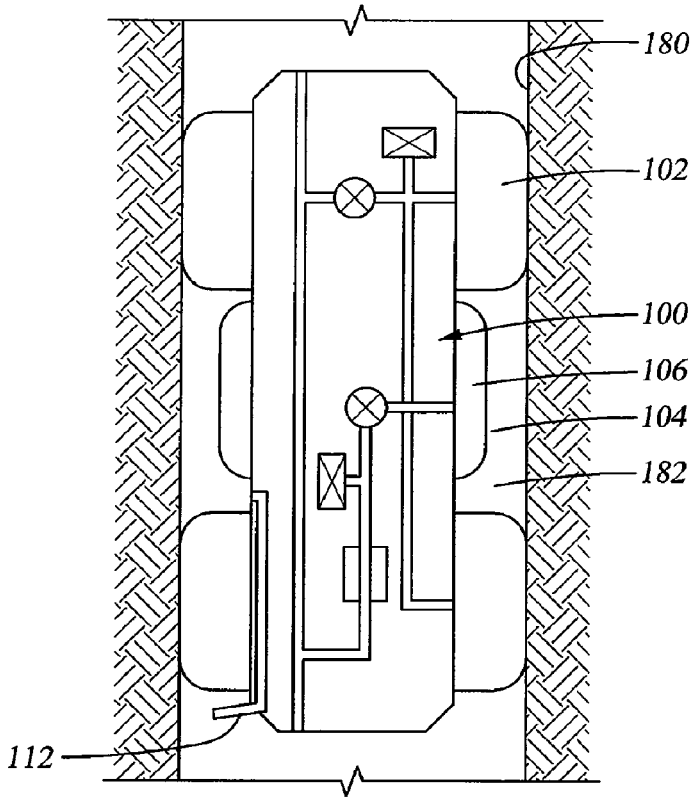
FIG. 3 illustrates a schematic view of a portion of a down hole apparatus as constructed in accordance with at least one embodiment.

FIGS. 1-4 illustrate an example of a downhole apparatus 100, such as a packer assembly. Referring to FIG. 1, the downhole apparatus, including the expandable packers 102, is disposed within a borehole 180. The expandable packers 102 include at least a first expandable packer longitudinally spaced from a second expandable packer along a downhole tool. Additional packers can be included. The expandable packers 102 can be expanded, for example, inflated, as shown in FIG. 2. When the packers 102 are expanded, the packers seal with the borehole 180, and creating a space 182 between the packers 102, where fluid 104 is trapped in the space 182. The fluid 104 can be drilling fluid, or other contaminated fluid.

Figure 4:
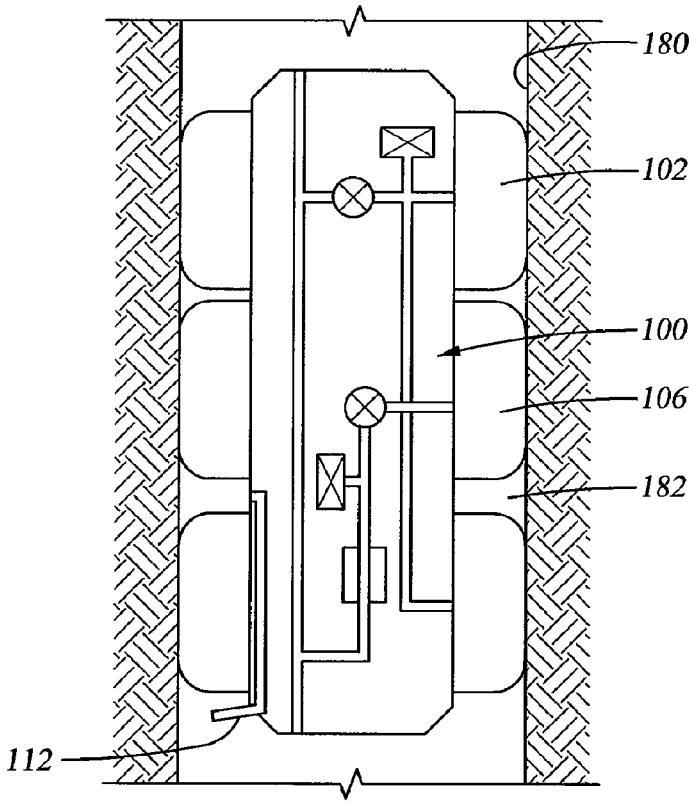
FIG. 4 illustrates a schematic view of a portion of a down hole apparatus as constructed in accordance with at least one embodiment.

In an option, the fluid is allowed to separate, as further described below. In another option, the fluid 104 is displaced. In an example, a volume exclusion bladder 106, prior to deployment, is disposed longitudinally between the packers 102. The volume exclusion bladder 106 is deployed, or expanded, as shown in FIG. 4. Trapped fluid 104 is driven out, for example, through an exhaust line 112 when the bladder 106 is expanded and displaces the trapped fluid 104. In an option, cleaning fluid is passed through the space 182, for instance, as the bladder 106 is expanded, or inflated. In yet another option, the fluid 104 can be displaced by introducing a gas in the space 182. The gas allows for the heavier, dirty fluid to flow to the lower portion of the space 182, and optionally expelled or displaced through the exhaust line. In an option, the gas can be pumped from the space 182, or chemically combined with the trapped fluid.

Figure 6:
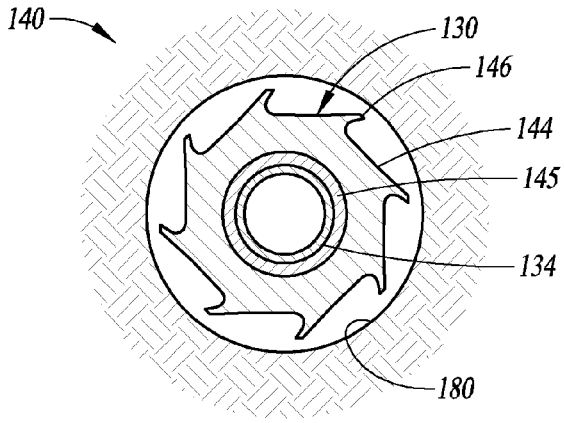
FIG. 6 illustrates a portion of a down hole apparatus as constructed in accordance with at least one embodiment.

FIGS. 5 and 6 illustrate portions of a downhole apparatus 100. In an option, the bladder 106 shown in FIGS. 3-4 includes a squeegee action bladder 130, where FIG. 6 illustrates a horizontal cross section 140 of the squeegee action bladder 130, and FIG. 5 illustrates a vertical cross section 142 of the squeegee action bladder 130. The bladder 130 is coupled with a tool mandrill 134, allowing for the bladder 130 to rotate. The bladder 130 includes flutes 144 and fins 146. Fins 146 will sweep, for example, the bore hole 180 as the bladder is inflated, and flutes 144 provide a flow path to the exhaust port 145. In an option, the squeegee action bladder 130 will squeegee a surface of the bore hole 180, and in another option the fins 146 contact the bore hole wall as the volume exclusion bladder 106 is rotated relative to the bore hole 180. In a further option, referring now to FIG. 12, the downhole apparatus 100 includes one or more ports (e.g., ports 150, 152) disposed longitudinally between the packers 102, such as a first port or a second port optionally operatively coupled with one or more pumps (e.g., pumps 210, 212). In an option, a first pump is operatively coupled with a first upper port, and a second pump is operatively coupled with a second lower port.

Figure 7:
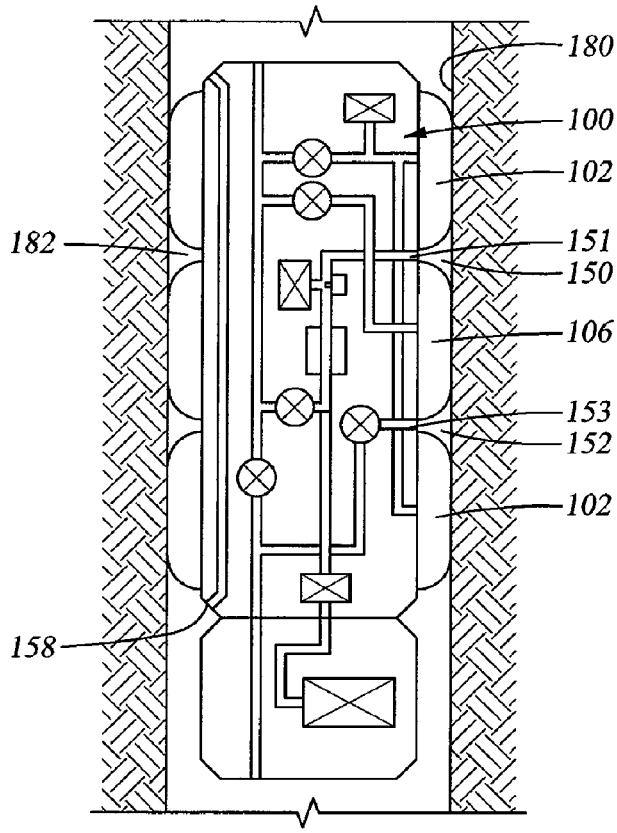
FIG. 7 illustrates a schematic view of a portion of a down hole apparatus as constructed in accordance with at least one embodiment.

In another example of a packer assembly, as shown in FIG. 7, the downhole apparatus 100 may be equipped with one, two, three or more expandable packers 102. The downhole apparatus 102 includes packers 102 and an optional bladder 106, and/or squeegee, with many variations as discussed above and below. In another option, the downhole apparatus 100 includes ports, such as an upper port 150 and a lower port 152, where upper and lower refer to the relative position of the ports along the apparatus 100. In an option, the packers 102 and the bladder 106 may be inflated and vertical interference testing may be performed from ports 150 and 152. Fluid may also be injected between port 150 to port 152, or port 152 to port 150, such as a cleaning fluid, which can be used to clean the space between the first and second expandable packers. In another option, a solvent is injected into the space 182. In an option, a distance between port 150 and port 152 may be varied, and bladder 106 and the distance may be varied by the size of the inflatable element and or the use of one or more elements.

In an example, as shown in FIG. 7, as the bladder 106 inflates, the drilling fluid 104 is displaced between the well bore 156 and the bladder 106. In an option, pressure measurements may be made between 150 and 152 to detect the value of equalization across the bladder 106 through bypass line 158. Bypass line 158 may or may not have a controllable choke or method to partially or completely block the flow path which may be used to determine the rate of flow. A method of measuring flow may be placed in the bypass line 158. The bladder 106 may be one or more elements depending on the required distance is to pack off.

The flowlines 153, 151 for port 152 and or port 150, respectively, may also be opened to allow fluid to be pumped above or below bladder 106 to record the flow through bypass line 158 or the pressure variations at 150 and 152.

Figure 8:
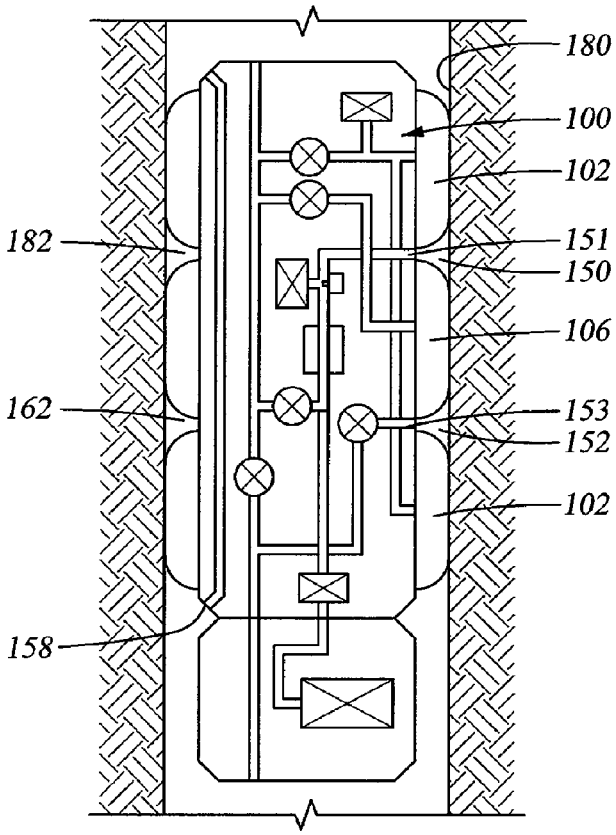
FIG. 8 illustrates a schematic view of a portion of a down hole apparatus as constructed in accordance with at least one embodiment.

Referring to FIG. 8, bladder 106 may be inflated further displacing drilling fluid either into the bore hole 180 or by using port 150 and or 152 as a flow path, a vertical interference testing may be performed from ports 150 and 152. Fluid may also be injected between 150 to 152 or 152 to 150, for example, to clean the space 182. During these tests bypass line will normally be open to allow pressure to equalize across bladder 106 but may be closed to restrict as needed. Distance between 150 and 152 may be varied by their location or by the size of the inflatable bladder 106. The apparatus shown in FIG. 8 may also inflate one or more of the packers 102 first and the while monitoring pressure at 150 and 152, and further optionally the bladder 106 is inflated while monitoring the effect of displacing the borehole fluid injecting into the formation.

In another option, bladder 106 is inflated, then displace drilling fluid with another fluid. One or more packers 102 could then be inflated monitoring the pressure at upper port 150 and lower port 152 for the effect of the displacement fluid being injected into the bore hole. Injected fluid may be allowed to pass through upper port 150 and or lower port 152 as the one or more packers 102 is inflated so to clean the bore hole as packer 102 is inflated.

Figure 9:
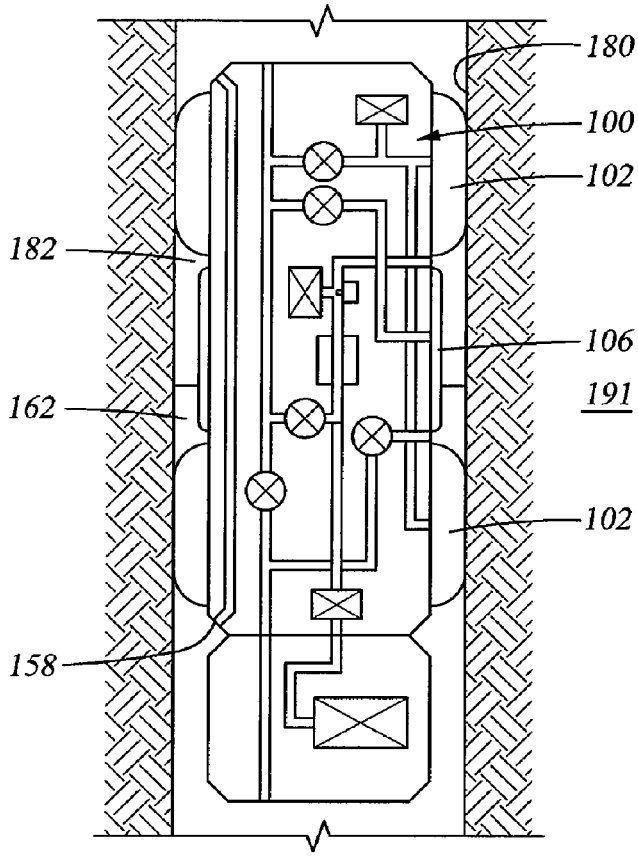
FIG. 9 illustrates a schematic view of a portion of a down hole apparatus as constructed in accordance with at least one embodiment.

FIG. 9 shows the optional expandable bladder 106. It should be noted that bladder 106 can be inflated or deflated at various rates depending of formation and or fluid parameters to enable formation fluid 191 to exit or enter the space 182 between packers 102 at a specific rate and/or pressure. As or after the packers 102 makes a significant seal of the borehole 180, formation fluid 191 between elements 156 may flow into the test interval between upper and lower ports, 150 and 152, respectively. The formation fluid 191 can be selectively pumped from the space 182 through one or more of the ports 150, 152.

Due to the displacement volume of the bladder 106, the volume of drilling fluid 162 left between upper port 150 and lower port 152 is less, and drilling fluid 162 is present at lower port 152, allowing a relatively clean sample to be taken from upper port 150 to sample the native fluid.

Figure 10:
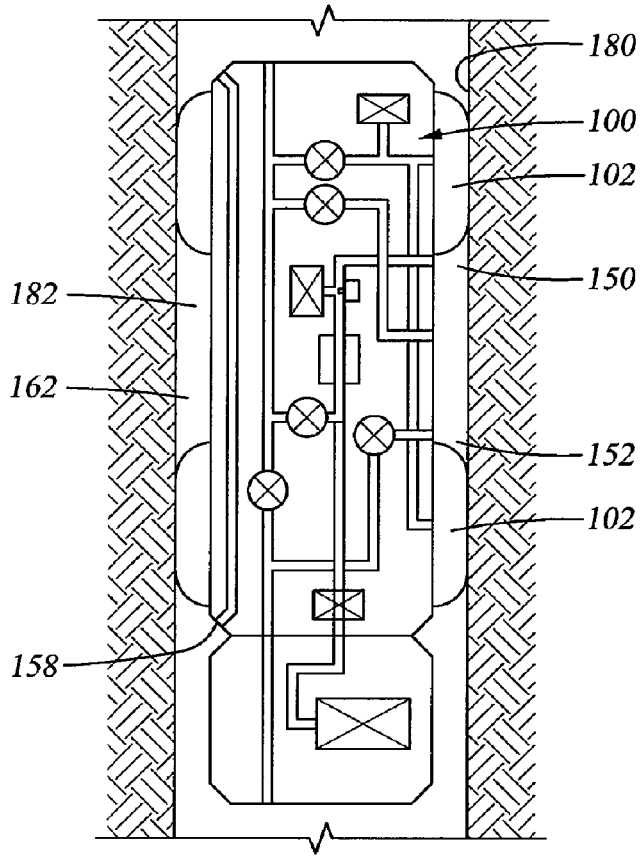
FIG. 10 illustrates a schematic view of a portion of a down hole apparatus as constructed in accordance with at least one embodiment.

FIG. 10 shows a packer assembly being set where packers 102 make a significant seal on the bore hole 180 and drilling fluid 162 is trapped between the elements between upper port 150 and lower port 152. This represents a sampling issue as the drilling fluid 162 contains debris which may block filters and or damage the pump.

Figure 11:
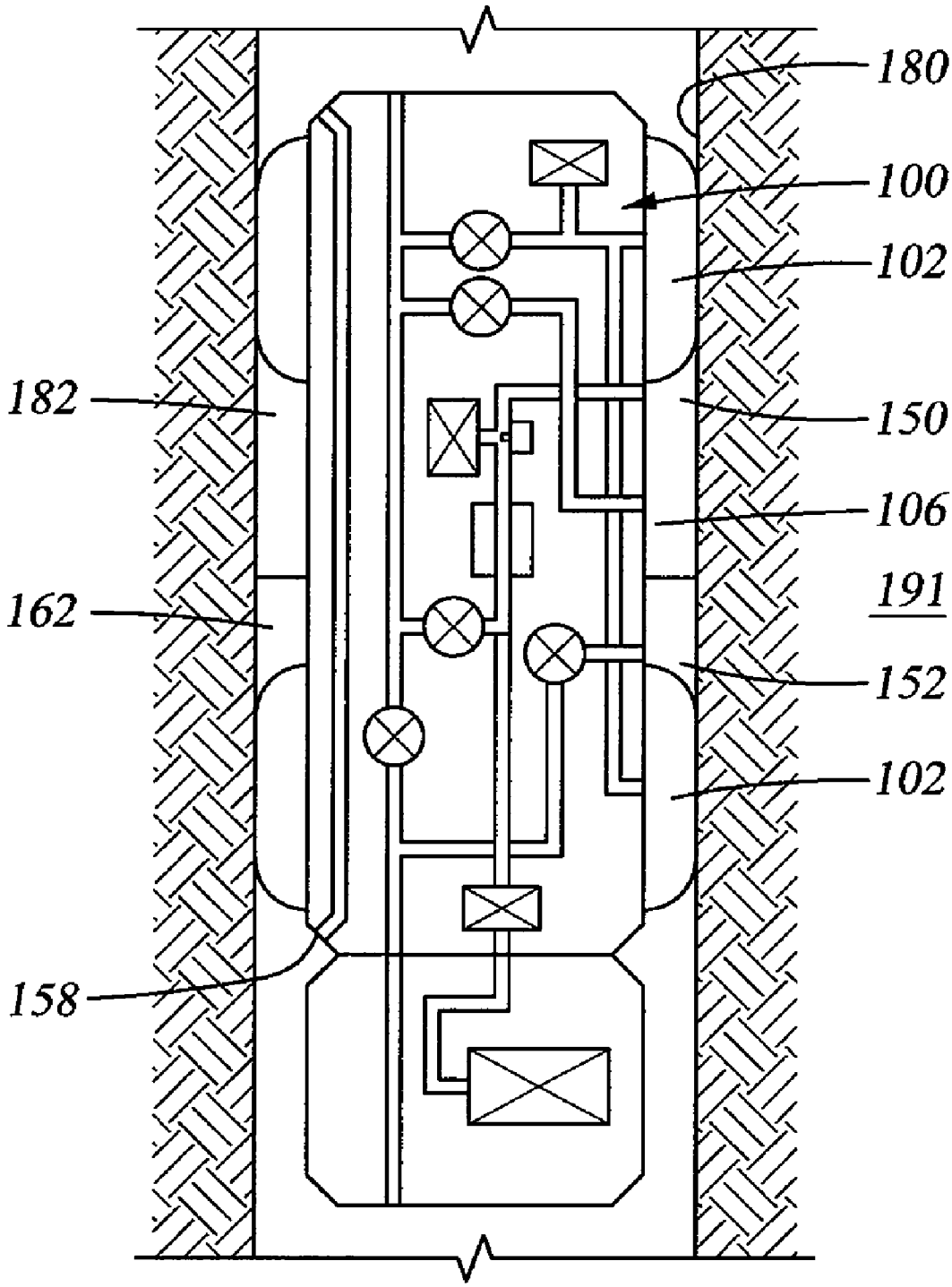
FIG. 11 illustrates a schematic view of a portion of a down hole apparatus as constructed in accordance with at least one embodiment.

FIG. 11 shows an embodiment where lower port 152 may be used to selectively pump or remove the drilling fluid 162 from the space 182 between the packers 102. This method would allow formation fluid 191 to enter the space 182 between upper port 150 lower port 152, and drilling fluid 162 would be displaced from the area around upper port 150 with the formation fluid 191. After the drilling fluid has been displaced from upper port 150, the upper port 150 may be utilized to sample the formation fluid 191.

FIG. 11 may also use a method where a lighter immiscible fluid may be pumped into upper port 150 allowing the drilling fluid 162 to be displaced out of lower port 152. This method would allow for large debris to be cleaned from the bore hold sample interval 182 between upper port 150 to lower port 152 without the need of the drilling fluid to pass through the pump.

FIGS. 12-15 illustrate additional embodiments which can be used in combination with the various features discussed above. The down hole apparatus 100 includes one or more packers 102 adapted to seal within a borehole 180. The down hole apparatus 100 further includes one or more ports, such as an upper port 150 and a lower port 152. Between the longitudinally spaced upper packer and lower packer, a space 182 is defined. Optionally, an expandable bladder 106 is disposed longitudinally between the packers 102. In a further option, one or more pumps can be used with the down hole apparatus 100, such as a first pump 210 for use with the upper port 150, and a second pump 212 for use with the lower port 152. In a further option, sample chambers are associated with the ports, such as a first sample chamber 250 communicatively coupled with the upper port 150 and a second sample chamber 252 communicatively coupled with the lower port 152. In an option, one or more sample chambers is selectively filled with the first pump 210. In another option, one or more sample chambers is selectively filled with the second pump 212.

Figure 12:
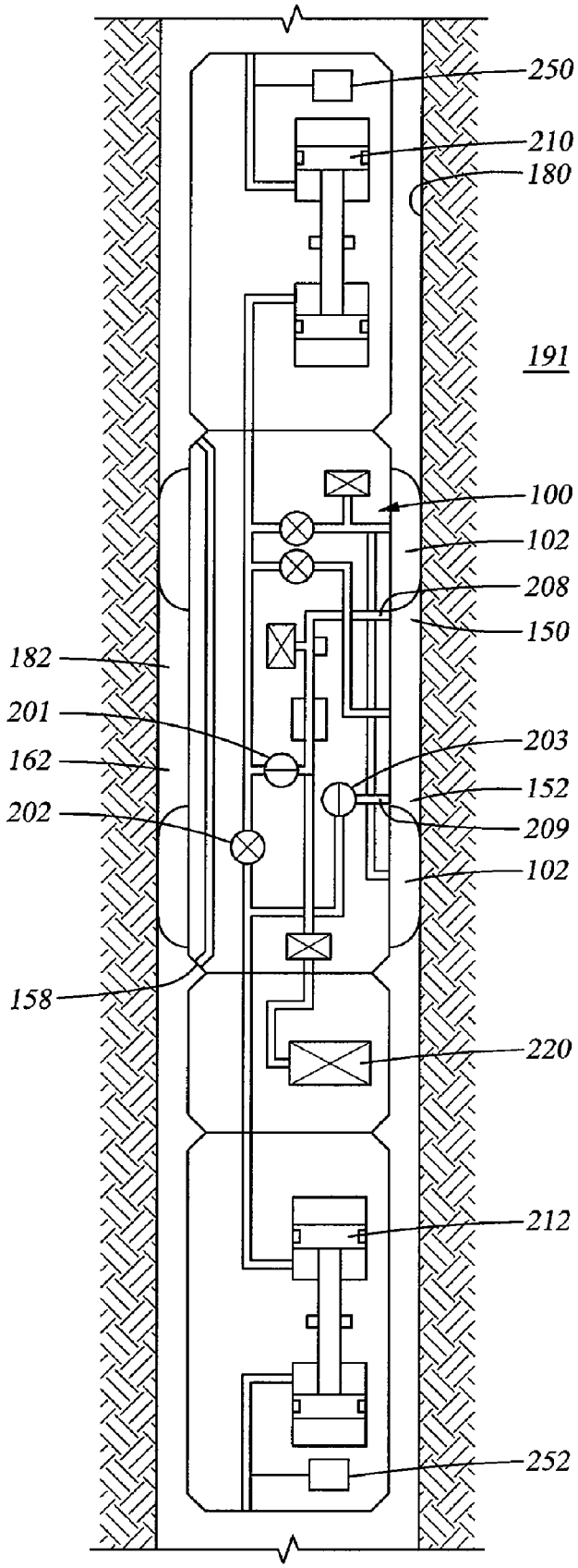
FIG. 12 illustrates a schematic view of a portion of a down hole apparatus as constructed in accordance with at least one embodiment.
Figure 13:
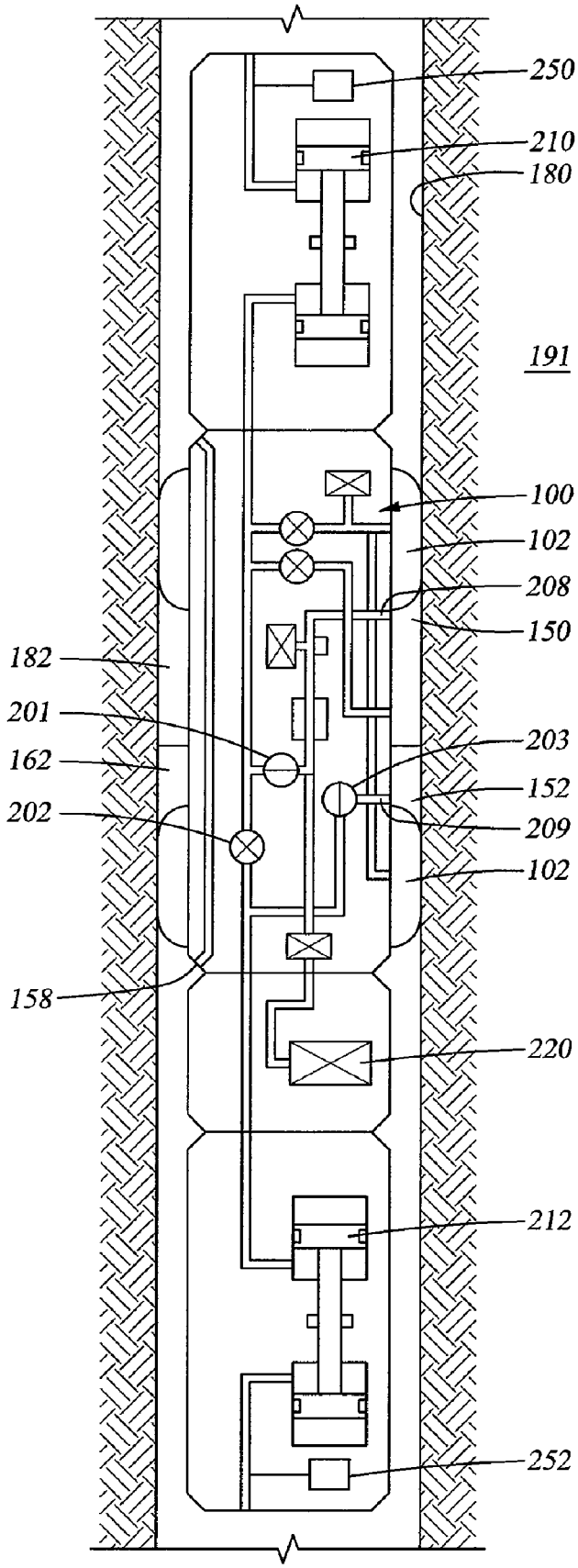
FIG. 13 illustrates a schematic view of a portion of a down hole apparatus as constructed in accordance with at least one embodiment.
Figure 14:
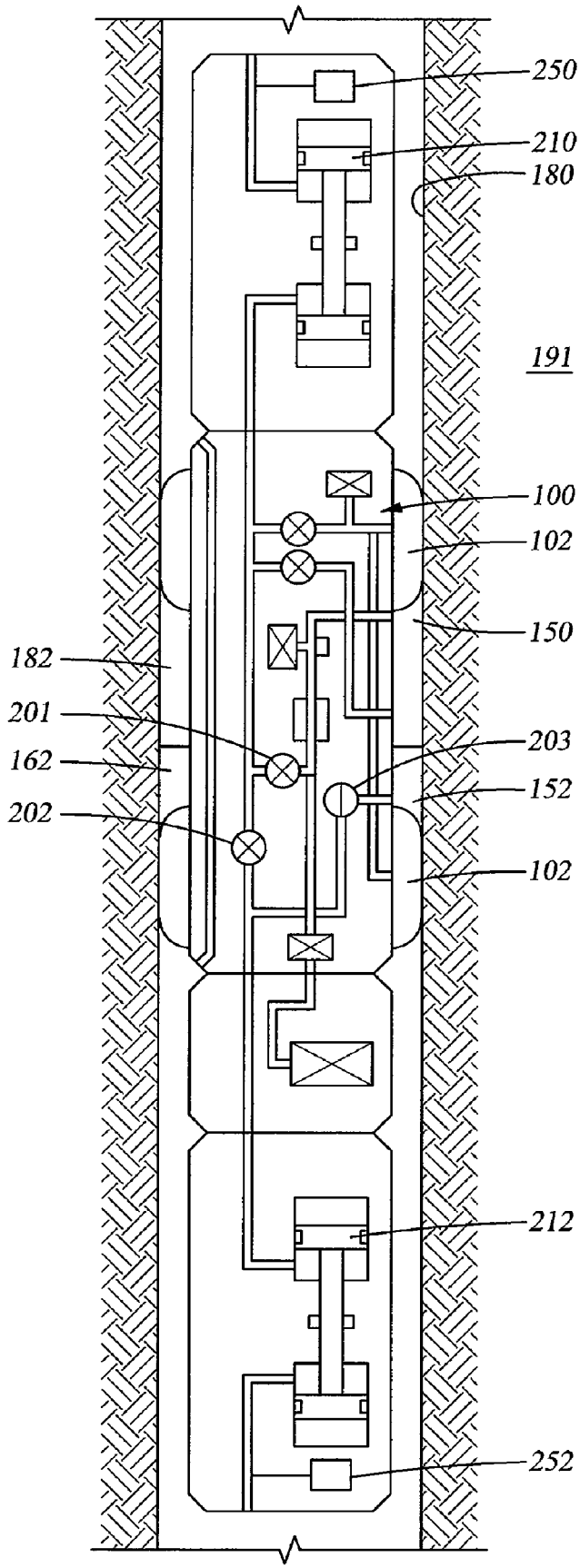
FIG. 14 illustrates a schematic view of a portion of a down hole apparatus as constructed in accordance with at least one embodiment.
Figure 15:
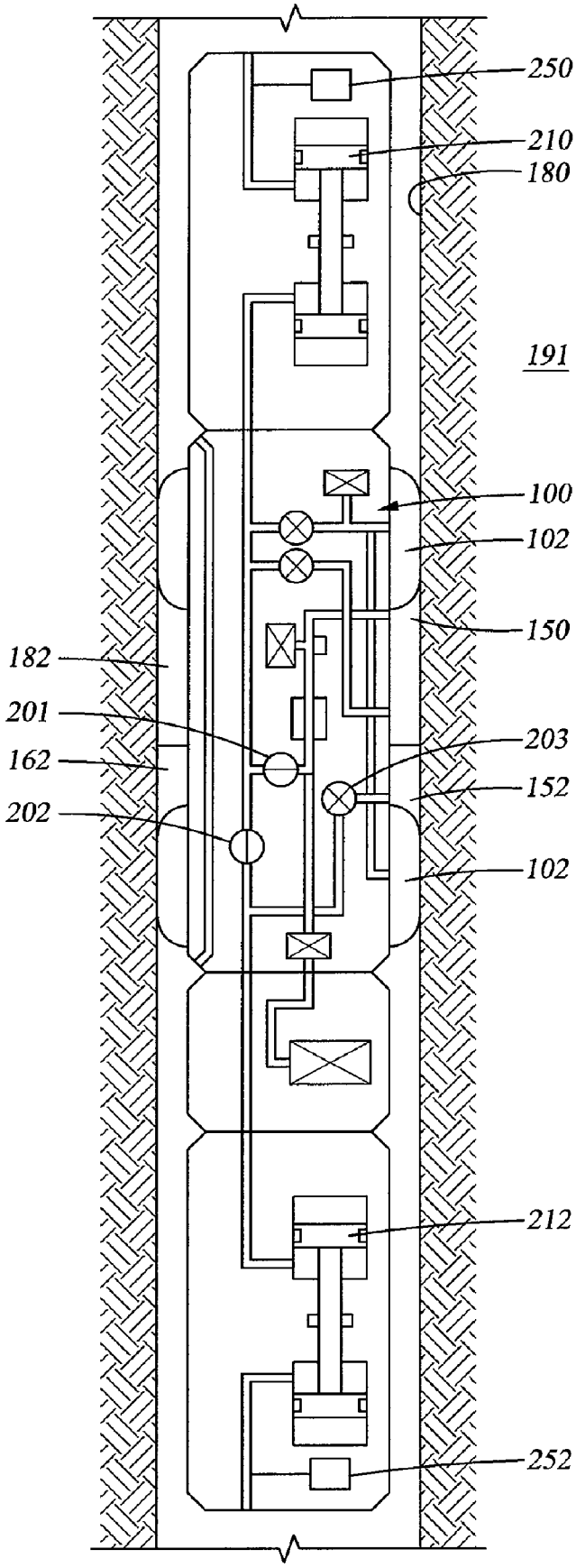
FIG. 15 illustrates a schematic view of a portion of a down hole apparatus as constructed in accordance with at least one embodiment.

FIG. 12 illustrates an embodiment where two pumps are provided, and a first pump 210 is connected to the upper port 150, and a second pump 212 is connected to the lower port 152, and both are used to draw fluid from the interval space 182, in an option, at the same time. In a further option, sample chambers 250, 252 are selectively filled by both pumps at the same time. FIG. 13 illustrates an embodiment where two pumps are connected to the straddle packer, and the fluids have separated and now the upper port is sampling the lighter fluid, for example by selectively pumping and placing the sampled fluid in sample chamber 250. FIG. 14 illustrates an embodiment where two pumps are connected to the straddle packer and the light formation fluid has been depleted from the upper portion of the interval space 182 while pumping from the upper port 150. FIG. 15 illustrates an embodiment where at least two pumps are connected to the straddle packer, and the lower port 152 has been closed after the fluid separation in the space 182, and both the upper and lower pumps 210, 212 are connected to the upper port 150 and sampling the lighter formation fluid.

Further details of FIGS. 12-15 are as follows. In an option, the fluids are allowed to separate in the space 182 between the packers 102 and/or the ports 150, 152, as discussed above. The fluids are excluded, or separated from one another, in an option, by using the natural tendency of fluids to separate within the isolated annular space 182 between the packers 102. In an option, a single pump can be connected to the upper and lower ports 150, 152. Then the pump withdraws fluid from the space 182 which in turn allows fluid from the formation to be drawn into the packer interval space 182. One or more pumps typically draws fluids into the flowline of the tool which can have fluid sensing devices to detect properties of the fluids and identify the fluid type (oil, water gas). The tool can selectively direct the flowline fluid to either be expelled into the wellbore or directed to a sample chamber using valves. Initially the fluids are expelled until the fluid sensors detect that formation fluids have entered the tool. Once formation fluids have entered the tool, the apparatus 100 can direct the pump and/or valves to switch to allow only the upper port 150 and its respective flow line to pump fluid.

Normally formation fluids are lighter than the drilling fluids originally occupying the packer interval space 182. Gradually formation fluids 191 start to segregate in the packer interval space 182 and after it enters the flowline 209 it will be detected by the fluid sensors. In another option, the fluid pumped from the lower port 152 can be sensed to determine when formation fluids 191 segregate in the space 182. When this occurs the tool can stop flowing from the lower port 152, and optionally switch to pump from the upper port 150. For instance, the lighter fluids are drawn from the upper port 150 and optionally fill a sample chamber 250, for example with the first pump 210. Alternatively the lower port 152 can be selected and the heavier fluid, such as the drilling fluid 162 can be sampled. This can be accomplished using flowline valves and a single pump, or by using two or more pumps.

A two pump system can be used as shown in FIG. 12, where a first pump 210 is operatively coupled with the upper port 150 via an upper flowline 208, and a second pump 212 is operatively coupled with the lower port 152 via a lower flowline 209. To insure the upper and lower flowlines 208, 209 are isolated, valve 202 is closed. As fluids are pumped from both upper and lower ports 150, 152, for example, at the same time, the lighter fluid starts to separate and enter the apparatus from the upper port 150 as shown in FIG. 13. As more formation fluid 191 enters the space 182, it eventually displaces the heavier fluids and the dirtier fluids, and the formation fluid 191 starts to enter the lower port 152. Fluid sensors can detect the increased presence of the formation fluids. When the appropriate presence of formation fluid is sensed, the lower port valve 203 can be closed and pristine formation fluids 191 will now enter the flowline through the upper port and the flow is directed to a sample chamber 250. In another option, the lower port 152 is pumped and fluids are sensed until the fluid sensor detects the formation fluids, and then the pump is connected to the upper port 150 to sample the lighter fluid. Then the upper valve port 201 is opened allowing the sample to be taken. This flow sequence can be altered to sample the heavier fluids if desired.

In yet another embodiment, two pumps can be used as shown in FIG. 14. In this case, the upper pump 210 and flowline 208 have been initially filled with a known fluid, such as water or light oil. This is done to preserve the cleanness of the pump and flow lines with a fluid can be easily identified when mixed with formation fluids. The lower pump 212 is connected to the lower port 152 and initially fluid is pumped from this lower port 152 until formation fluids 191 are detected with the fluid sensors. At this point the lower pump 212 is stopped and the lower port 152 closed. Then the upper port 150 is connected to the upper pump 210 and the lighter formation fluid start to displace the clean flowline fluids. Fluid sensors detect when the clean fluid has been displaced and then the sample chamber can be filled. Having a known fluid in the flowline and pump prior to sampling can yield a cleaner formation sample. Furthermore, any residual flowline fluid can be easily identified and separated from the sample which makes any analysis for the fluid properties or composition more accurate.

In another option, both the upper and lower pumps 210, 212 can withdraw fluids from the upper and lower ports 150, 152 simultaneously. This has the advantage of maintaining the fluid separation since heavier fluids can still be entering the interval space 182 causing the heavier fluid level to rise and potentially contaminate the sample. As before, the sequence can be changed to alternatively sample the heavier fluids or actually sample both fluids at the same time. In a further option, additional ports and/or pumps can be included on the apparatus. With additional ports and/or pumps, it would be possible to select different portions from the interval space 182. For example if gas, oil, and water were present and separated, they would be at different locations along the space 182, and ports could sample each of these. A forth port could be used to selectively sample a four component fluid system such as gas, oil, water and contaminated water.

In view of the wide variety of permutations to the embodiments described herein, this detailed description is intended to be illustrative only, and should not be taken as limiting the scope of the invention. What is claimed, therefore, is all such modifications as may come within the scope of the following claims and equivalents thereto. Therefore, the specification and drawings are to be regarded in an illustrative rather than a restrictive sense.

The invention claimed is:

1. A method comprising:

disposing a downhole apparatus into a borehole;

expanding at least a first expandable packer and a second expandable packer within a borehole, and sealing the first expandable packer and the second expandable packer with the borehole, the first expandable packer is longitudinally spaced from the second expandable packer and defining a space between the first expandable packer and the second expandable packer, one or more ports disposed between the first expandable packer and the second expandable packer;

allowing fluid in the space to separate into separated fluids; and selectively pumping at least one of the separated fluids out of the space through the one or more ports.

2. The method as recited in claim 1, further comprising selectively pumping fluid into the space between the first expandable packer and the second expandable packer through the one or more ports.

3. The method as recited in claim 1, wherein selectively pumping includes pumping fluid through at least an upper port and a lower port.

4. The method as recited in claim 3, further comprising pumping one of the at least one separated fluids out through the lower port.

5. The method as recited in claim 3, further comprising pumping the at least one of the separated fluids out through the upper port.

6. The method as recited in claim 3, further comprising pumping fluid through upper port with a first pump and pumping fluid through the lower port with the second pump.

7. The method as recited in claim 6, further comprising selectively filling one or more sample chambers with at least one of the first pump or the second pump.

8. The method as recited in claim 1, further comprising filling one or more sample chambers with one of the at least one separated fluids.

9. The method as claim 3, further comprising sensing the fluid pumped from at least one of either the upper port or lower port, and switching to pumping from the other port.

10. The method as recited claim 1, further comprising displacing fluid between the first and second expandable packers.

11. The method as recited in claim 10, wherein displacing fluid between the first and second expandable packers includes displacing drilling fluid with formation fluid or with an expandable bladder.

12. The method as recited in claim 1, further comprising pumping an immiscible fluid in an upper port, where the immiscible fluid is lighter in weight than the fluid trapped by the expandable packers, and pumping the fluid trapped by the expandable packers from a lower port.

13. The method as recited in claim 1, further comprising injecting fluid between the first and second expandable packers and cleaning the space between the first and second expandable packers.

14. A method comprising:

disposing a downhole apparatus into a borehole;

expanding at least a first expandable packer and a second expandable packer within a borehole, and sealing the first expandable packer and the second expandable packer with the borehole, the first expandable packer is longitudinally spaced from the second expandable packer and defining a space between the first expandable packer and the second expandable packer; and displacing fluid trapped between the first expandable packer and the second expandable packer using an inflatable bladder.

15. The method as recited in claim 14, wherein displacing fluid trapped between the first expandable packer and the second expandable packer includes inflating a bladder disposed longitudinally between the first expandable packer and the second expandable packer, and passing cleaning fluid through the space while the bladder is inflated.

16. The method as recited in claim 14, further comprising employing a squeegee and cleaning the bore hole.

17. The method as recited in claim 14, wherein displacing the fluid includes introducing a gas into the space.

18. The method as recited in claim 17, further comprising pumping the gas from the space.

19. The method as recited in claim 17, further comprising chemically combining the gas with the trapped fluid.

20. A down hole apparatus comprising:

a first expandable packer and a second expandable packer disposed along a down hole tool, the first expandable packer longitudinally spaced from the second expandable packer;

a volume excluder bladder disposed at a longitudinal location between the first expandable packer and the second expandable packer; and one or more ports disposed longitudinally between the first expandable packer and the second expandable packer, wherein the ports include a first upper port and a second lower port, and further comprising a first pump operatively coupled with the first upper port, and a second pump operatively coupled with the second lower port.

21. The down hole apparatus as recited in claim 20, wherein the volume excluder bladder is a squeegee action bladder, the squeegee action bladder adapted to squeegee a surface of a well bore.

22. The down hole apparatus as recited in claim 20, wherein the volume excluder bladder includes one or more flutes, where the flutes provide a flow path to an exhaust port.

23. The down hole apparatus as recited in claim 20, wherein the volume excluder bladder includes one or more fins, and the one or more fins are adapted to contact a bore hole wall as the volume excluder bladder is rotated relative to the bore hole.

* * * * *

UNITED STATES PATENT AND TRADEMARK OFFICE

CERTIFICATE OF CORRECTION

PATENT NO. : 7,866,387 B2
APPLICATION NO. : 12/356229
DATED : January 11, 2011
INVENTOR(S) : Anthony H. van Zuilekom et al.

It is certified that error appears in the above-identified patent and that said Letters Patent is hereby corrected as shown below:

In column 8, line 23, in Claim 9, delete "as" and insert -- as recited in --, therefor.

Signed and Sealed this
Fifth Day of April, 2011

David J. Kappos

David J. Kappos
*Director of the United States Patent and Trademark Office*